US012522462B2

(12) United States Patent
Fujiwara

(10) Patent No.: US 12,522,462 B2
(45) Date of Patent: Jan. 13, 2026

(54) SHEET DISCHARGING DEVICE INCLUDING ELASTIC PIECES ARRANGED OFFSET FROM ROLLER BODY OF DISCHARGING ROLLER IN WIDTH DIRECTION

(71) Applicant: BROTHER KOGYO KABUSHIKI KAISHA, Nagoya (JP)

(72) Inventor: Takashi Fujiwara, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 99 days.

(21) Appl. No.: 18/544,724

(22) Filed: Dec. 19, 2023

(65) Prior Publication Data

US 2024/0208758 A1 Jun. 27, 2024

(30) Foreign Application Priority Data

Dec. 26, 2022 (JP) ..... 2022-207844

(51) Int. Cl.
*B65H 29/52* (2006.01)
*B65H 29/22* (2006.01)

(52) U.S. Cl.
CPC ..... *B65H 29/22* (2013.01); *B65H 29/52* (2013.01); *B65H 2301/4433* (2013.01)

(58) Field of Classification Search
CPC ..... B65H 29/22; B65H 29/52; B65H 2301/4433; B65H 31/00; B65H 31/26; B65H 2404/694; B65H 2404/6942
See application file for complete search history.

(56) References Cited

U.S. PATENT DOCUMENTS

| | | | | |
|---|---|---|---|---|
| 9,296,578 | B2 * | 3/2016 | Ohta | G03G 15/6552 |
| 9,580,262 | B2 * | 2/2017 | Kurokawa | B65H 29/14 |
| 2007/0210512 | A1 * | 9/2007 | Sakakibara | B65H 31/02 271/212 |
| 2014/0210156 | A1 * | 7/2014 | Ohta | G03G 15/6552 271/314 |
| 2017/0107071 | A1 | 4/2017 | Agata | |
| 2019/0033769 | A1 * | 1/2019 | Shiina | B65H 43/06 |
| 2019/0225451 | A1 * | 7/2019 | Kotani | B65H 37/04 |
| 2020/0209799 | A1 * | 7/2020 | Isobe | B65H 29/70 |

FOREIGN PATENT DOCUMENTS

| | | |
|---|---|---|
| JP | 2001253613 A | 9/2001 |
| JP | 2017077941 A | 4/2017 |

* cited by examiner

*Primary Examiner* — Thomas A Morrison
(74) *Attorney, Agent, or Firm* — Element IP, PLC

(57) ABSTRACT

A sheet discharging device includes: a discharging roller, elastic pieces, and a discharge tray. The discharging roller includes: a shaft extending in a width direction, and a roller body configured to convey a sheet in a discharging direction. The elastic pieces protrude in the discharging direction and are arranged upward relative to the shaft and offset from the roller body in the width direction. Each elastic piece has a surface facing downward. The surface has a portion directly above the shaft. The portion is positioned downward relative to an upper end of the roller body while not contacting the sheet. The elastic pieces include: a first elastic piece including a bending portion bent toward the discharge tray, and second elastic pieces not including a bending portion bent toward the discharge tray. The first elastic piece and the second elastic pieces are alternately arranged in the width direction.

20 Claims, 12 Drawing Sheets

SHEET DISCHARGING DEVICE INCLUDING ELASTIC PIECES ARRANGED OFFSET FROM ROLLER BODY OF DISCHARGING ROLLER IN WIDTH DIRECTION

REFERENCE TO RELATED APPLICATIONS

This application claims priority from Japanese Patent Application No. 2022-207844 filed on Dec. 26, 2022. The entire content of the priority application is incorporated herein by reference.

BACKGROUND ART

There has been conventionally known a sheet discharging device includes a first rotation shaft, a second rotation shaft, a first discharging roller body, a second discharging roller body, and a sheet stacking portion.

The first rotation shaft and the second rotation shaft extend in a width direction orthogonal to a direction in which a sheet is conveyed toward the sheet stacking portion. The first rotation shaft is positioned upward relative to the second rotation shaft. The first discharging roller body is configured to rotate together with the first rotation shaft. The second discharging roller body is configured to rotate together with the second rotation shaft. The first discharging roller body is positioned offset from the second discharging roller body in the width direction. The lower end of the outer circumferential surface of the first discharging roller body is positioned downward relative to the upper end of the outer circumferential surface of the second discharging roller body.

The first discharging roller body and the second discharging roller body are configured to convey the sheet in a discharging direction. The sheet stacking portion is configured to support the sheet discharged thereon. At this time, the first discharging roller body and the second discharging roller body enhances the rigidity of the sheet by deforming the sheet into a wavy shape when viewed in the discharging direction, stabilizing the posture of the sheet being discharged.

Also, the conventional sheet discharging device further includes a contacting flag member, which is a part of a discharge detection sensor. The contacting flag member extends in the discharging direction from a position upper than the first rotation shaft while sloping downward. The contacting flag member also has a function to drop the rear end of the sheet onto the sheet stacking portion after the sheet has passed between the first discharging roller body and the second discharging roller body.

With this configuration, the conventional sheet discharging device attempts to improve the stacking performance of the sheets discharged on the sheet stacking portion.

SUMMARY

However, it is difficult to make the conventional sheet discharging device compact in the up-down direction since the first rotation shaft and the first discharging roller body are positioned further upward than the second rotation shaft in the conventional sheet discharging device. In addition, the above-described configuration that the contacting flag member extends in the discharging direction from a position upper than the first rotation shaft while sloping downward is also a factor that makes it challenging to make the conventional sheet discharging device compact in the up-down direction.

In view of the foregoing, it is an object of the present disclosure to provide a sheet discharging device which can be made compact in the up-down direction while enhancing the stacking performance of the sheets discharged onto the discharge tray with a simple structure.

In order to attain the above and other objects, according to one aspect, the present disclosure provides a sheet discharging device including a lower sheet guide, a discharging roller, a plurality of elastic pieces, and a discharge tray. The lower sheet guide has an upper surface configured to guide a sheet. The discharging roller includes a shaft and a roller body. The shaft is positioned downward relative to the upper surface. The shaft extends in a width direction orthogonal to a conveying direction of the sheet being guided by the upper surface. The roller body is configured to rotate together with the shaft. The roller body is configured to convey the sheet being guided by the upper surface in a discharging direction. Each of the plurality of elastic pieces protrudes in the discharging direction. Each elastic piece is arranged upward relative to the shaft and offset from the roller body in the width direction. The discharge tray is configured to support the sheet discharged by the discharging roller. Each elastic piece has a surface facing downward. The surface of each elastic piece has a portion directly above the shaft. The portion is positioned downward relative to an upper end of an outer circumferential surface of the roller body in a state where the portion is not in contact with the sheet being guided by the upper surface. The plurality of elastic pieces includes a first elastic piece and a plurality of second elastic pieces. The first elastic piece includes a bending portion bent toward the discharge tray. The bending portion is positioned downstream in the discharging direction relative to the shaft. Each of the plurality of second elastic pieces is shorter than the first elastic piece. Each second elastic piece does not include a bending portion bent toward the discharge tray. The first elastic piece and the plurality of second elastic pieces are alternately arranged in the width direction.

According to another aspect, the present disclosure provides a sheet discharging device including a lower sheet guide, a discharging roller, a pressing member, and a discharge tray. The lower sheet guide has an upper surface configured to guide a sheet. The discharging roller includes a shaft and a roller body. The shaft is positioned downward relative to the upper surface. The shaft extends in a width direction orthogonal to a conveying direction of the sheet being guided by the upper surface. The roller body is configured to rotate together with the shaft. The roller body is configured to convey the sheet being guided by the upper surface in a discharging direction. The pressing member is configured to press the sheet being discharged by the discharging roller. The pressure member includes a plurality of elastic pieces protruding in the discharging direction. Each elastic piece is arranged upward relative to the shaft and offset from the roller body in the width direction. The discharge tray is configured to support the sheet discharged by the discharging roller. Each elastic piece has a surface facing downward. The surface of each elastic piece has a portion directly above the shaft. The portion is positioned downward relative to an upper end of an outer circumferential surface of the roller body in a state where the portion is not in contact with the sheet being guided by the upper surface. The plurality of elastic pieces includes a first elastic piece and a plurality of second elastic pieces. The first elastic piece includes a bending portion bent toward the discharge tray. The bending portion is positioned downstream in the discharging direction relative to the shaft. Each of the plurality of second elastic pieces is shorter than the first elastic piece. Each second elastic piece does not include a bending portion bent toward the discharge tray. The first elastic piece and the plurality of second elastic pieces are alternately arranged in the width direction.

DESCRIPTION

Hereinafter, first through fourth embodiments of the present disclosure will be described while referring to the accompanying drawings.

First Embodiment

Figure 1:
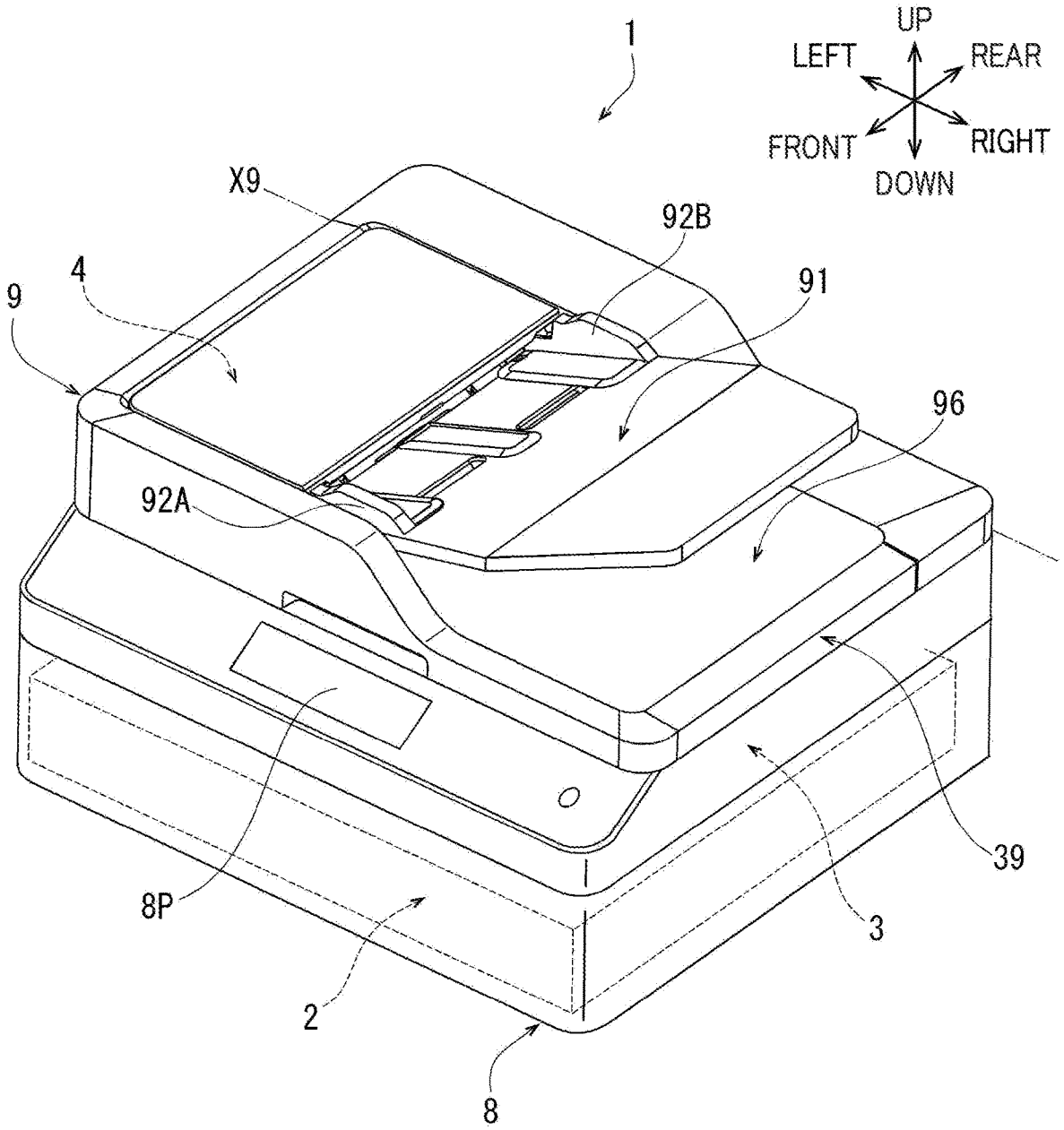
FIG. 1 is a perspective view of an image-reading device.

As illustrated in FIG. 1, an image-reading device 1 according to the first embodiment is an example of embodiments of the sheet-discharging device of the present disclosure.

As illustrated in FIG. 1, the image-reading device 1 includes an operation panel 8P. As indicated in FIG. 1, the side of the image-reading device 1 on which the operation panel 8P is positioned will be defined as the front side. The side of the image-reading device 1 corresponding to the left-hand side of a user facing the operation panel 8P from the front will be defined as the left side. Directions (front, rear, up, down, left, and right) shown in all the other drawings (FIG. 2 and subsequent drawings) correspond to the directions indicated in FIG. 1.

<Overall Structure>

As illustrated in FIG. 1, the image-reading device 1 includes a main body 8 and a cover 9. The main body 8 has a substantially flattened box-like shape. The operation panel 8P is positioned at the front surface of the main body 8. The operation panel 8P is a touch panel, for example. The main body 8 accommodates an image-forming-unit 2 in the lower portion of the main body 8. The image-forming unit 2 is configured to form an image on a sheet according to a prescribed method, such as an inkjet method, a laser method, or other methods.

Figure 2:
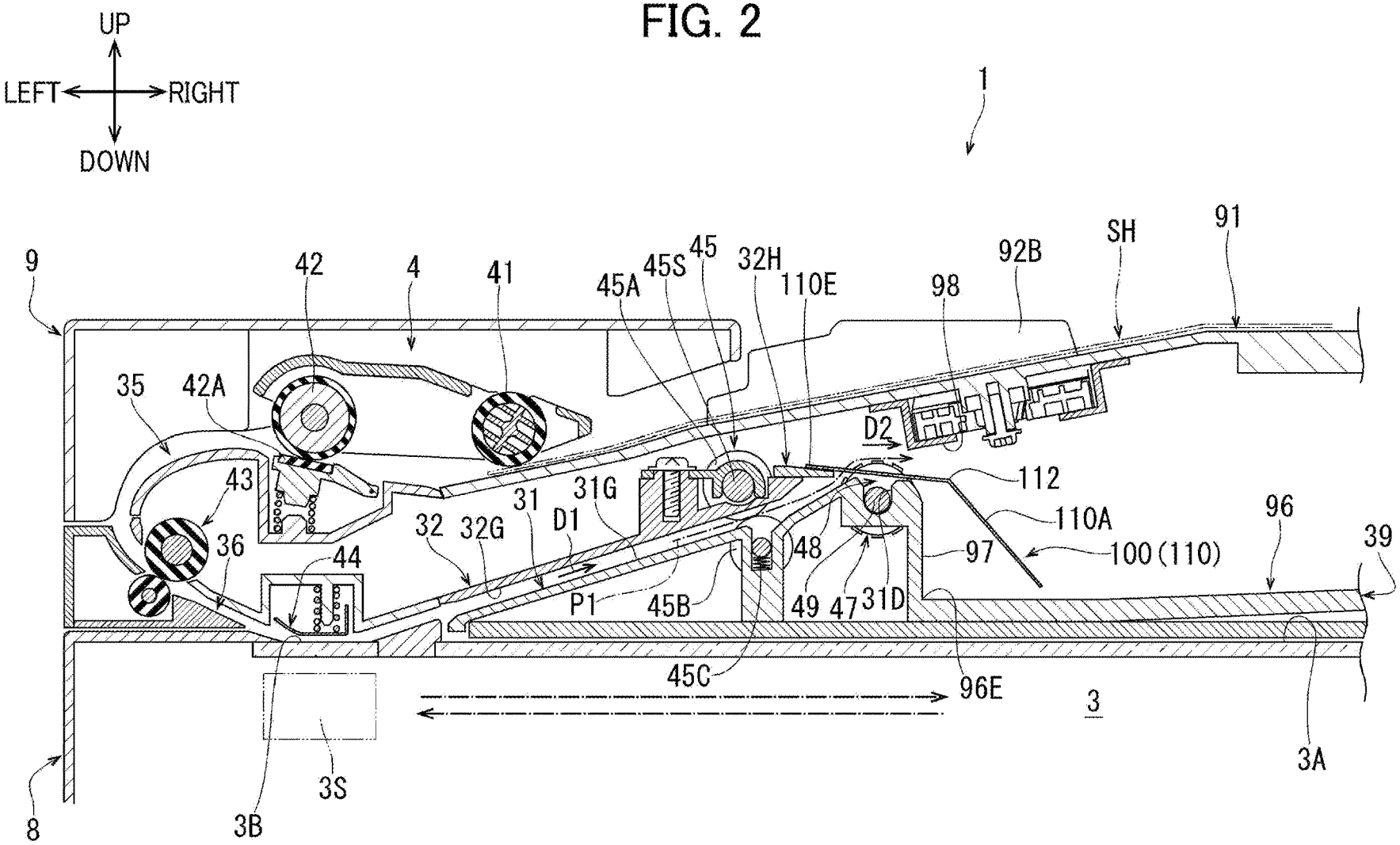
FIG. 2 is a schematic partial cross-sectional view of the image-reading device.

As illustrated in FIG. 2, the main body 8 accommodates an image-reading unit 3 in the upper portion of the main body 8. The image-reading unit 3 includes an original document supporting surface 3A, a reading surface 3B, a reading sensor 3S and a scanning mechanism (not illustrated).

The main body 8 includes two platen glasses, which constitute the upper surface of the main body 8. One platen glass of the two platen glasses has a large area. The upper surface of the one platen glass constitutes the original document supporting surface 3A. The other platen glass of the two platen glasses is slender and elongated in the front-rear direction and is positioned leftward of the original document supporting surface 3A. The upper surface of the other platen glass constitutes the reading surface 3B.

The original document supporting surface 3A supports an original document to be subjected to image-reading. Examples of the original document to be subjected to image-reading include a sheet such as a sheet of paper and a transparent plastic film (overhead projector sheets), and a book. The reading surface 3B is used when a conveying unit 4 described later operates.

The reading sensor 3S is a well-known image-reading sensor, such as a contact image sensor (CIS), a charge coupled device (CCD), or other types of sensors. The reading sensor 3S is slender and elongated in the front-rear direction. The reading sensor 3S is positioned downward relative to both the original document supporting surface 3A and reading surface 3B.

In a case where the image-reading unit 3 reads an image formed on the original document supported by the original document supporting surface 3A, the reading sensor 3S reads the image of the original document by the operation of the scanning mechanism (not illustrated). More specifically, the reading sensor 3S is configured to read the image of the original document line by line, which extends in the front-rear direction (i.e., in a main scanning direction), while moving rightward (i.e., in a sub scanning direction) from a position below the left end edge of the original document supporting surface 3A. When the reading sensor 3S has moved to a position below the right end edge of the original document supporting surface 3A, the reading sensor 3S finishes the reading of the image and returned to a standby position by the operation of the scanning mechanism (not illustrated).

Note that, when the conveying unit 4 described later operates, the reading sensor 3S moves to a static reading position below the reading surface 3B by the operation of the scanning mechanism (not illustrated) and rests at the static reading position.

As illustrated in FIG. 1, the cover 9 is positioned above the main body 8. The cover 9 has a rear end connected to the rear end of the main body 8 by a hinge (not illustrated). The cover 9 is pivotally movable about a pivot axis X9 extending in the left-right direction.

As illustrated in FIG. 2, the cover 9 includes a base member 39, which is made of resin. The base member 39 has a lower surface that forms the bottom surface of the cover 9. The bottom surface of the cover 9 is of a size that can cover the entire upper surface of the main body 8. The cover 9 uses the lower surface of the base member 39 to cover the original document placed on the original document supporting surface 3A.

Although not illustrated, when a user pivotally moves the cover 9 upward and rearward about the pivot axis X9, the cover 9 exposes the original document supporting surface 3A. In a state where the original document supporting surface 3A is exposed, a user can place the original document on the original document supporting surface 3A and take the original document out of the image-reading device 1.

As illustrated in FIGS. 1 and 2, the cover 9 includes a feeding tray 91 and a discharge tray 96. The feeding tray 91 and the discharge tray 96 are positioned at the right portion of the cover 9.

The discharge tray 96 is constituted by the upper surface of the right portion of the base member 39. The feeding tray 91 is positioned above the discharge tray 96. The feeding tray 91 supports the sheets SH to be subjected to image-reading in a stacked state.

Note that, in the present embodiment, an object to be subjected to image-reading using the original document supporting surface 3A will be referred to as the "original document". An object to be subjected to image-reading while being conveyed by the conveying unit 4 will be referred to as the "sheet SH". The original document and the sheet SH may be substantially the same as each other.

The feeding tray 91 includes a side guide 92A and a side guide 92B. The side guides 92A and 92B are configured to slide both toward and away from each other in the front-rear direction. With this configuration, the side guides 92A and 92B can position the sheets SH of various sizes supported on the feeding tray 91 in the front-rear direction. In the present embodiment, examples of the sheets SH to be subjected to image-reading include a postcard, an A4-size paper, and an A5-size paper.

As illustrated in FIG. 2, the cover 9 includes the conveying unit 4, a first conveying guide 35, a second conveying guide 36, a lower sheet guide 31, and an upper sheet guide 32. The conveying unit 4, the first conveying guide 35, the second conveying guide 36, the lower sheet guide 31, and the upper sheet guide 32 are positioned inside the left portion of the cover 9.

The conveying unit 4 includes a feeding roller 41, a separating roller 42, a separating pad 42A, a pair of first conveying rollers 43, a pressure member 44, a pair of second conveying rollers 45, a discharging roller 47, and plurality of elastic pieces 100. The pair of second conveying rollers 45 is an example of the "pair of conveying rollers" of the present disclosure.

The feeding roller 41 faces the left end portion of the feeding tray 91 from above. The separating roller 42 and the separating pad 42A are positioned leftward relative to the feeding roller 41. The pair of first conveying rollers 43 is positioned near the left side wall of the cover 9 and near the upper surface of the main body 8. The pressure member 44 is positioned directly above the reading surface 3B.

The first conveying guide 35 and the second conveying guide 36 are configured of some of chute members provided inside the cover 9 and libs protruding downward from the lower surface of the upper wall of the cover 9.

The first conveying guide 35 is configured to guide the sheet SH from the left end portion of the feeding tray 91 to the pair of first conveying rollers 43.

The second conveying guide 36 is configured to guide the sheet SH from the pair of the first conveying rollers 43 to the reading surface 3B in a direction sloped downward (i.e., in a diagonal direction sloping downward and rightward) so that the sheet SH passes between the pressure member 44 and the reading surface 3B (i.e., so that the sheet SH passes through an area above the reading sensor 3S positioned at the static reading position).

<Lower Sheet Guide and Upper Sheet Guide>

The lower sheet guide 31 is provided at the left portion of the base member 39. The lower sheet guide 31 has an upper surface 31G. The upper surface 31G is a sloped surface facing upward. The upper surface 31G extends from a position rightward of the reading surface 3B in a diagonal direction sloping upward and rightward. The upper surface 31G also extends in the front-rear direction.

The upper sheet guide 32 is positioned upward relative to the lower sheet guide 31. The upper sheet guide 32 has a lower surface 32G. The lower surface 32G faces the upper surface 31G of the lower sheet guide 31 from above. The lower surface 32G is a sloped surface facing downward. The lower surface 32G extends from a position rightward of the reading surface 3B in a diagonal direction sloping upward and rightward. The lower surface 32G also extends in the front-rear direction.

The upper surface 31G of the lower sheet guide 31 and the lower surface 32G of the upper sheet guide 32 define a discharge path P1 therebetween. In other words, the discharge path P1 is defined between the upper surface 31G and the lower surface 32G. The upper surface 31G and the lower surface 32G are configured to guide the sheet SH along the discharge path P1 in a conveying direction D1 after the sheet SH has passed between the pressure member 44 and the reading surface 3B.

The conveying direction D1 of the sheet SH being guided by the upper surface 31G and the lower surface 32G (i.e., a direction in which the sheet SH is conveyed while guided by the upper surface 31G and the lower surface 32G) is a diagonal direction sloping upward and rightward. A width direction, which is orthogonal to the conveying direction D1, is the front-rear direction. In the present embodiment, the width direction encompasses two opposite directions: one direction is the frontward direction, and the other direction is the rearward direction.

Figure 3:
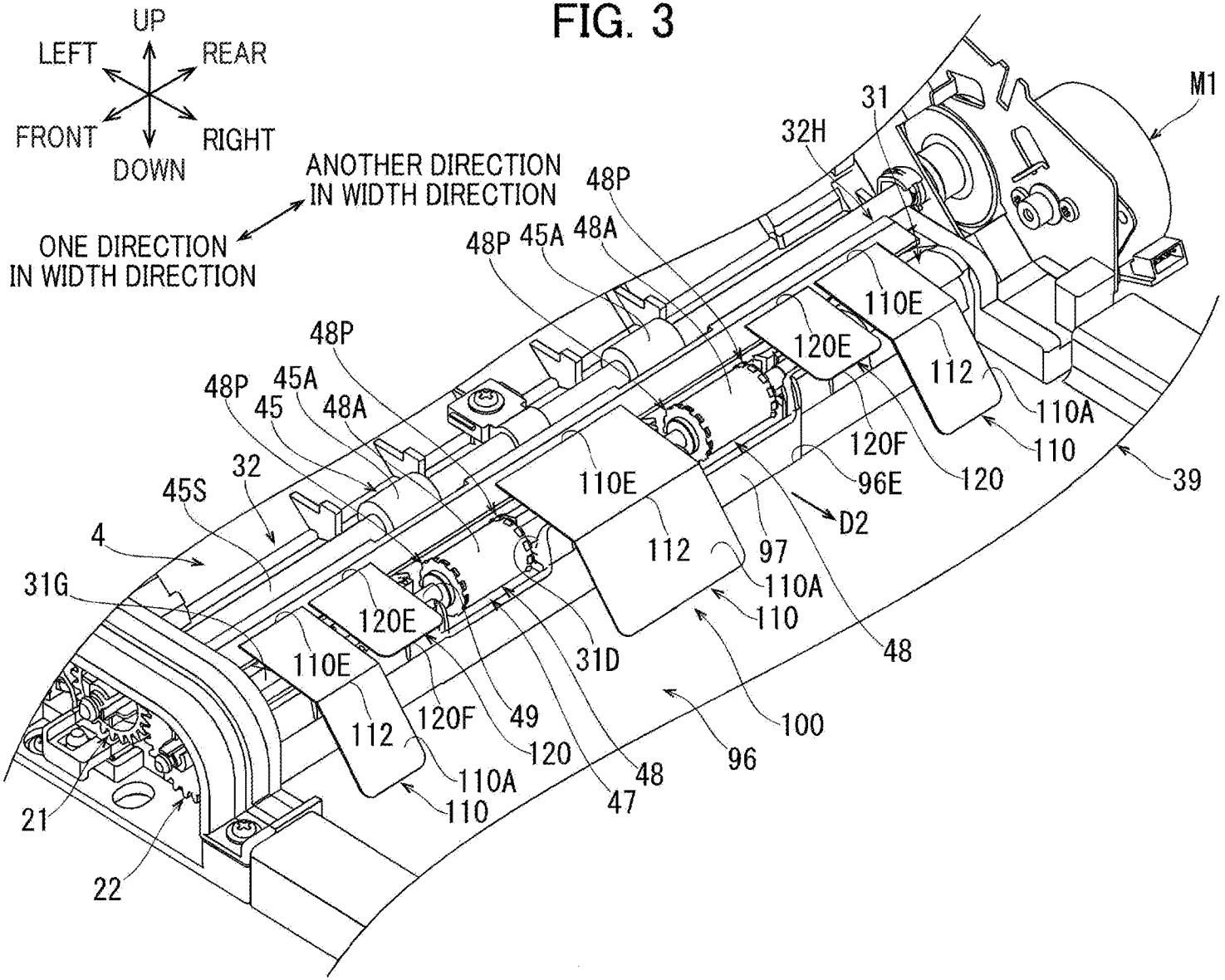
FIG. 3 is a perspective view of part of the image-reading device and specifically illustrates a discharging roller, first elastic pieces, second elastic pieces, a discharge tray, and other components.

As illustrated in FIGS. 2 and 3, the lower sheet guide 31 includes a shaft accommodating portion 31D. The shaft accommodating portion 31D is a groove near the right end of the upper surface 31G. The shaft accommodating portion 31D is recessed downward and extends in the front-rear direction. The portion of the upper surface 31G that is on the right side of the shaft accommodating portion 31D slightly extends rightward in the approximately horizontal direction and then is curved downward to reach the right end of the upper surface 31G.

After the sheet SH has been guided by the upper surface 31G of the lower sheet guide 31 and the lower surface 32G of the upper sheet guide 32 in the conveying direction D1, the sheet SH is guided in a discharging direction D2 at the right end portion of the upper surface 31G. The discharging direction D2 is the rightward direction in the approximately horizontal direction.

The base member 39 has a regulating surface 97 positioned between the lower sheet guide 31 and the discharge tray 96. The discharge tray 96 has an upstream end 96E in the discharging direction D2. The regulating surface 97 is a flat surface facing in the discharging direction D2 and connected to the upstream end 96E of the discharge tray 96. The regulating surface 97 extends upward in the vertical direction and also extends in the width direction.

The regulating surface 97 has an upper end connected to the right end of the upper surface 31G. The regulating surface 97 is configured to regulate the position of the upstream end of the sheet SH in the discharging direction D2 that has been guided along the discharge path P1 and discharged onto the discharge tray 96.

An elastic piece holding portion 32H is fixed to the upper surface of the right end portion of the upper sheet guide 32. The elastic piece holding portion 32H is elongated from one end to the other end of the upper sheet guide 32 in the front-rear direction, and slightly extends in the left-right direction.

<Pair of Second Conveying Rollers>

The pair of second conveying rollers 45 is positioned downstream relative to the center portion of the discharge path P1 and upstream relative to the discharging roller 47 in the discharging direction D2. The pair of second conveying rollers 45 includes a driving shaft 45S, two driving rollers 45A and two follow rollers 45B. The driving rollers 45A are each an example of the "driving roller body" in the present disclosure. The two follow rollers 45B are each an example of the "follow roller body" in the present disclosure.

The driving shaft 45S is positioned upward relative to the lower surface 32G of the upper sheet guide 32 and extends in the width direction. As illustrated in FIG. 3, the two driving rollers 45A are fixed to the driving shaft 45S at positions spaced apart from each other in the width direction.

A first gear 21 is fixed to one end portion of the driving shaft 45S in the width direction. The first gear 21 is positioned further in the one direction in the width direction than both the upper surface 31G of the lower sheet guide 31 and the lower surface 32G of the upper sheet guide 32. That is, the first gear 21 is positioned further in the one direction in the width direction than the discharge path P1. In the present embodiment, the first gear 21 is positioned frontward relative to both the upper surface 31G and the lower surface 32G. In other words, the first gear 21 is positioned frontward relative to the discharge path P1.

The driving shaft 45S is configured to rotate by receiving a driving force transmitted from a motor M1 via a drive train (not illustrated). The motor M1 is positioned further in the other direction in the width direction than the discharge path P1. With this configuration, the two driving rollers 45A and the first gear 21 rotate together with the driving shaft 45S.

As illustrated in FIG. 2, the two follow rollers 45B are positioned on the side on which the upper surface 31G of the lower sheet guide 31 is positioned. Each of the two follow rollers 45B faces to the corresponding driving roller 45A. Each follow roller 45B is urged toward the corresponding driving roller 45A by an urging spring 45C.

The pair of second conveying rollers 45 is configured to convey the sheet SH being guided by the upper surface 31G of the lower sheet guide 31 and the lower surface 32G of the upper sheet guide 32 toward the discharging roller 47.

<Discharging Roller>

Figure 4:
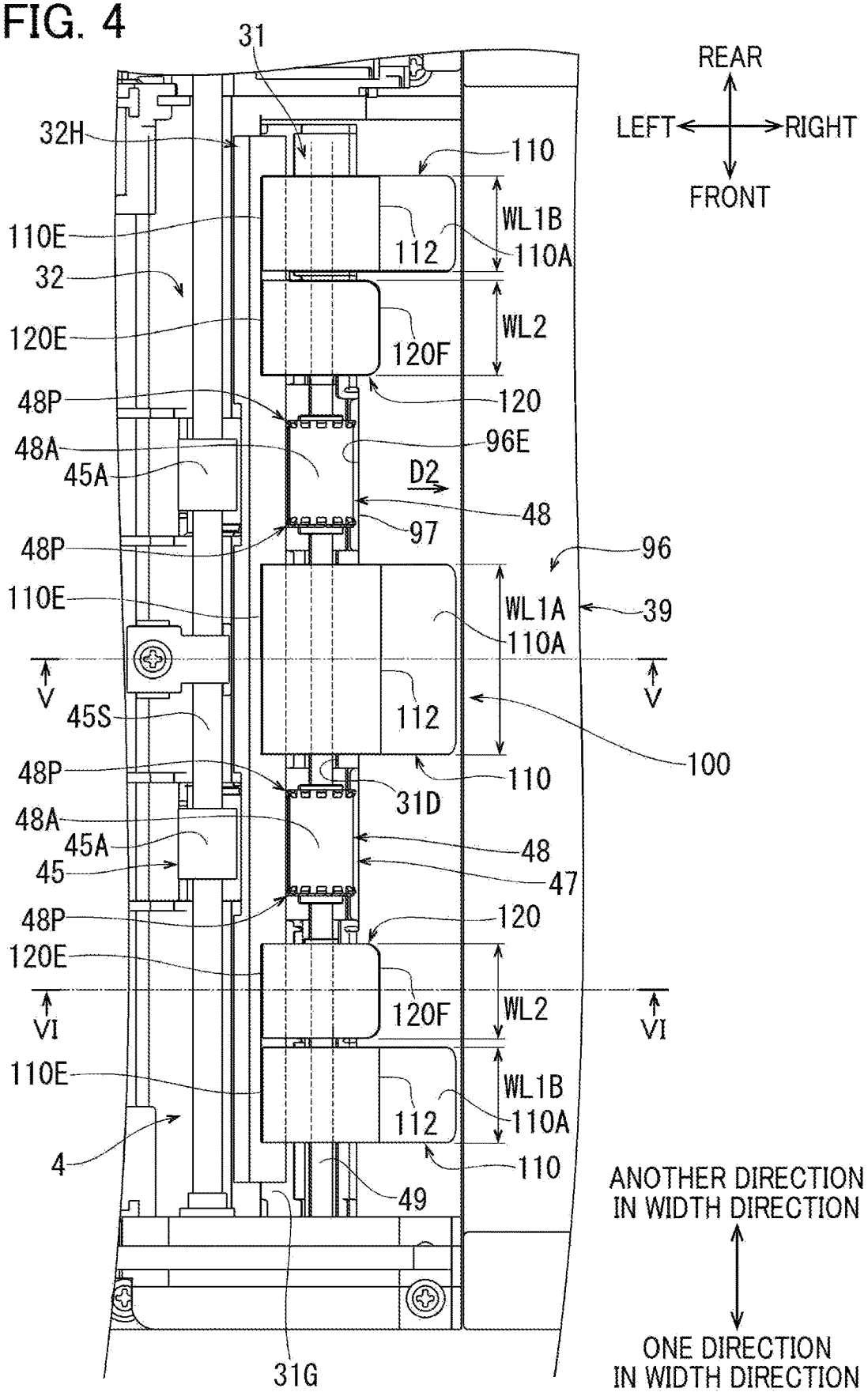
FIG. 4 is a plan view of part of the image-reading device and specifically illustrates the discharging roller, the first elastic pieces, the second elastic pieces, the discharge tray, and other components.

As illustrated in FIGS. 2 through 4, the discharging roller 47 includes a shaft 49 and two rollers 48. The shaft 49 is accommodated in the shaft accommodating portion 31D of the lower sheet guide 31. The shaft 49 is positioned downward relative to the upper surface 31G and extends in the width direction. The rollers 48 are each an example of the "roller body" in the present disclosure.

As illustrated in FIG. 3, the two rollers 48 are fixed to the shaft 49 at positions spaced apart from each other in the width direction. The rollers 48 are made of rubber. In the present embodiment, the rollers 48 are made of ethylene propylene diene monomer (EPDM) robber. Each roller 48 has an outer circumferential surface 48A. The outer circumferential surface 48A is a cylindrical surface extending in the width direction without step portions or irregularities.

Each end portion of the outer circumferential surface 48A of each roller 48 in the width direction has a paddle 48P. The paddle 48P includes a plurality of protrusions arranged apart from one another in the circumferential direction of the outer circumferential surface 48A. At the time of the roller 48 finishing conveyance of the sheet SH, the protrusions of the paddles 48P can push out the sheet SH by contacting the left end of the sheet SH (i.e., the upstream end of the sheet SH in the conveying direction D2).

A second gear 22 is fixed to one end portion of the shaft 49 in the width direction. The second gear 22 is positioned further in the one direction in the width direction than the discharge path P1. The second gear 22 is meshingly engaged with the first gear 21.

The second gear 22 is configured to receive a driving force transmitted from the driving shaft 45S via the first gear 21, whereby the second gear 22 and the two rollers 48 rotate together with the shaft 49.

The two rollers 48 are configured to convey the sheet SH being guided by the upper surface 31G of the lower sheet guide 31 and the lower surface 32G of the upper sheet guide 32 in the discharging direction D2 and to discharge the sheet SH onto the discharge tray 96. The positions of the two rollers 48 in the up-down direction are higher than those of the two follow rollers 45B, and accordingly, the maximum number of the sheets SH that can be stacked on the discharge tray 96 is increased by the height difference.

<Elastic Pieces>

As illustrated in FIGS. 2 through 4, each of the elastic pieces 100 has a plate-shaped piece protruding in the discharging direction D2. The elastic pieces 100 are arranged at positions upward relative to the shaft 49 and offset from the rollers 48 in the width direction.

In the present embodiment, the elastic pieces 100 are film-like members and are manufactured by being cutting out from PET (polyethylene terephthalate) films, for example. Each elastic piece 100 has a thickness that can provide such rigidity that the elastic piece 100 does not bend when the elastic piece 100 comes into contact with the sheet SH. In the present embodiment, each elastic piece 100 is configured of a PET film having a thickness of 25 μm.

As illustrated in FIGS. 3 and 4, the elastic pieces 100 include first elastic pieces 110 and second elastic pieces 120.

Figure 5:
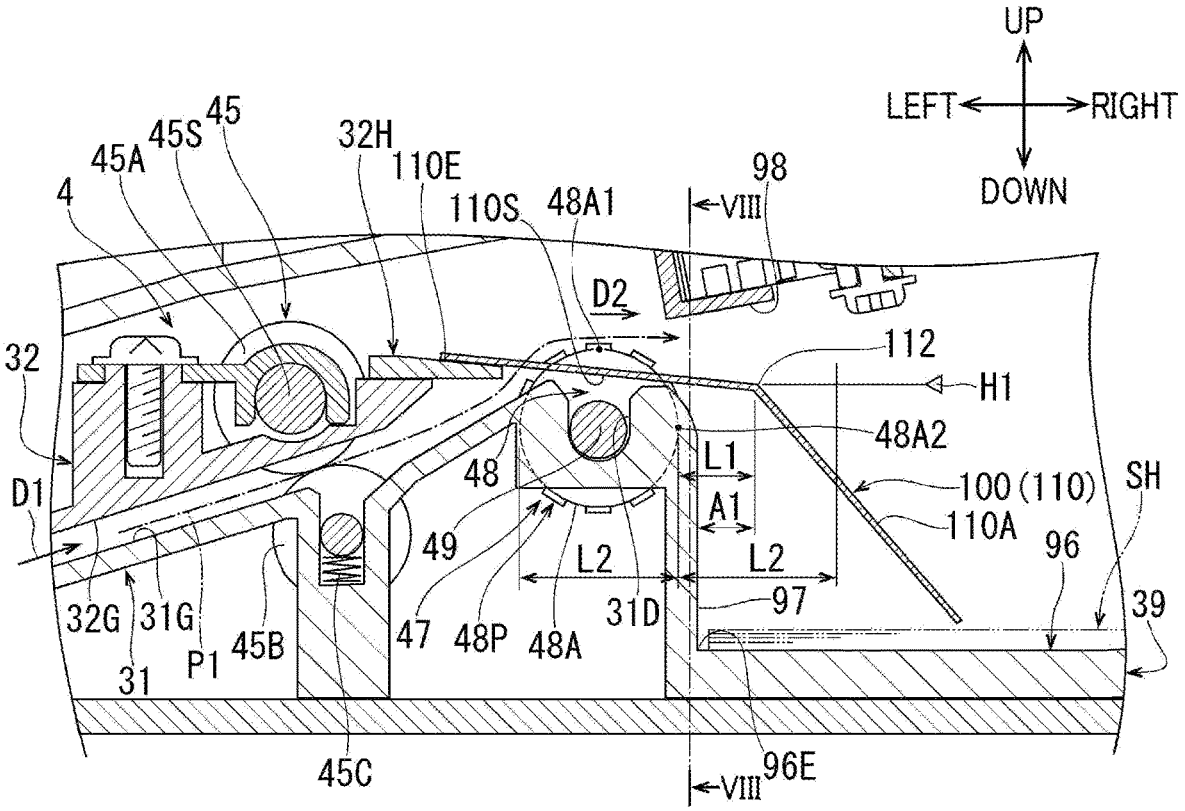
FIG. 5 is a schematic partial cross-sectional view of the image-reading device taken along line V-V in FIG. 4.

As illustrated in FIG. 5, each first elastic piece 110 has an upstream end portion 110E in the discharging direction D2. The upstream end portions 110E of the first elastic pieces 110 are attached to the upper surface of the elastic piece holding portion 32H. For example, the upstream end portions 110E of the first elastic pieces 110 may be affixed or bonded to the upper surface of the elastic piece holding portion 32H with adhesive. The upstream end portions 110E of the first elastic pieces 110 are held by the upper sheet guide 32 via the elastic piece holding portion 32H.

Each first elastic piece 110 protrudes in the discharging direction D2 from the upstream end portion 110E while slightly sloping downward. Each first elastic piece 110 extends across the discharge path P1 in a state where the first elastic piece 110 is not in contact with the sheet SH being guided by the upper surface 31G of the lower sheet guide 31.

Each first elastic piece 110 has a lower surface facing downward. The lower surface of each first elastic piece 110 includes a portion 110S that is positioned directly above the shaft 49. Each portion 110S is positioned downward relative to an upper end 48A1 of the outer circumferential surface 48A of each roller 48 in a state where the portion 110S is not in contact with the sheet SH being guided by the upper surface 31G of the lower sheet guide 31.

Each first elastic piece 110 includes a bending portion 112 and a portion 110A. The bending portion 112 is positioned downstream relative to the shaft 49 in the discharging direction D2 and is bent toward the discharge tray 96. The portion 110A is a portion positioned downstream relative to the bending portion 112 in the discharging direction D2. The portion 110A has a flat-plate shape extending toward the discharge tray 96. The portion 110A slopes downward in the discharging direction D2. More specifically, the bending portion 112 is positioned downstream relative to the regulating surface 97 in the discharging direction D2.

The outer circumferential surface 48A of each roller 48 has a downstream end 48A2 in the discharging direction D2. The downstream end 48A2 and the bending portion 112 of the first elastic piece 110 are spaced apart from each other by a distance L1 in the discharging direction D2. The outer circumferential surface 48A has a diameter L2. The distance L1 is smaller than the diameter L2.

Figure 6:
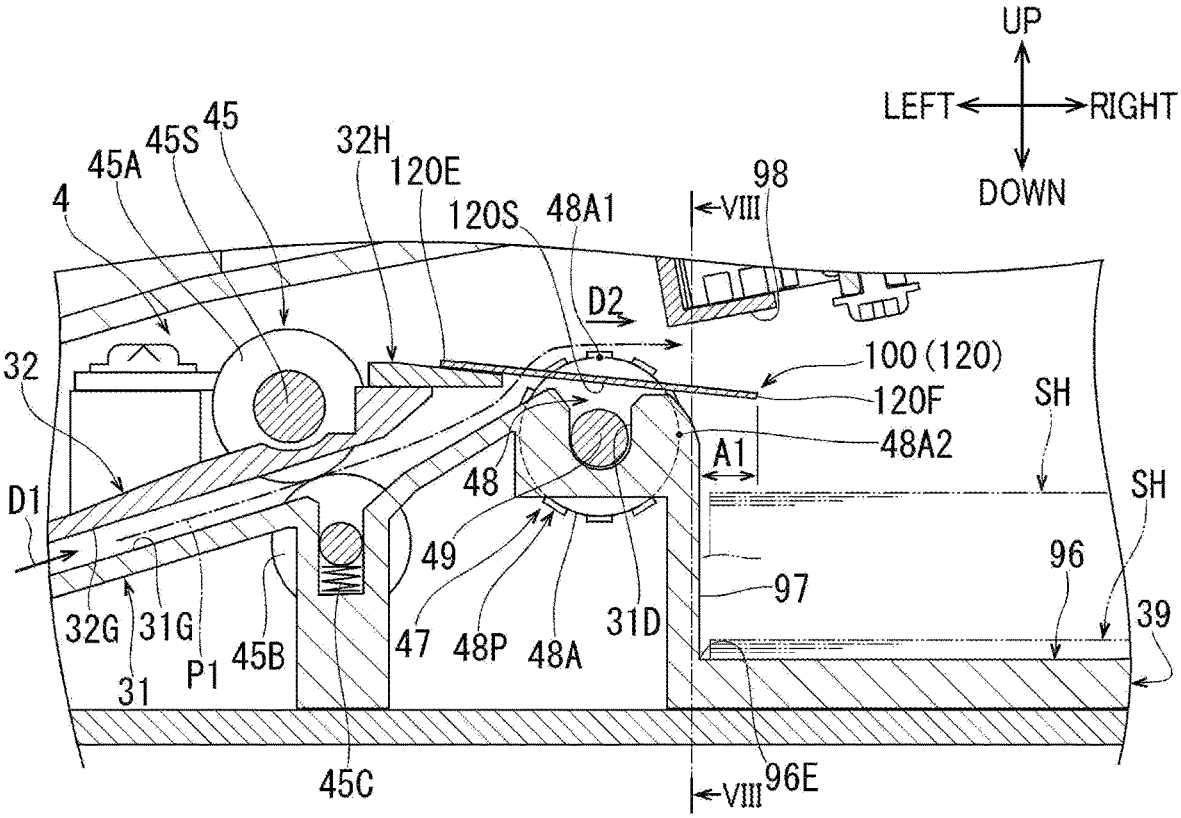
FIG. 6 is a schematic partial cross-sectional view of the image-reading device taken along line VI-VI in FIG. 4.

As illustrated in FIG. 6, each second elastic piece 120 has an upstream end portion 120E and a downstream end portion 120F in the discharging direction D2. Similarly to the upstream end portions of the first elastic pieces 110, the upstream end portions 120E of the second elastic pieces 120 are attached to the upper surface of the elastic piece holding portion 32H. For example, the upstream end portions 120E of the second elastic pieces 120 may be affixed or bonded to the upper surface of the elastic piece holding portion 32H with adhesive. That is, the upstream end portions 120E of the second elastic pieces 120 are held by the upper sheet guide 32 via the elastic piece holding portion 32H.

Similarly to the first elastic pieces 110, each second elastic piece 120 also protrudes in the discharging direction D2 from the upstream end portion 120E while slightly sloping downward. Each second elastic piece 120 extends across the discharge path P1 in a state where the second elastic piece 120 is not in contact with the sheet SH being guided by the upper surface 31G of the lower sheet guide 31.

Each second elastic piece 120 has a lower surface facing downward. The lower surface of each second elastic piece 120 includes a portion 120S that is positioned directly above the shaft 49. Similarly to the above-described portions 110S of the first elastic pieces 110, each portion 120S is positioned downward relative to the upper end 48A1 of the outer circumferential surface 48A of each roller 48 in a state where the portion 120S is not in contact with the sheet SH being guided by the upper surface 31G of the lower sheet guide 31.

Each second elastic piece 120 does not include a bending portion bent toward the discharge tray 96 on the downstream side of the shaft 49 in the discharging direction D2. Also, the downward inclination angle of the portion of the first elastic piece 110 which extends from the upstream end portion 110E to the bending portion 112 is the same as the downward inclination angle of the portion of the second elastic piece 120 which extends from the upstream end portion 120E to the downstream end portion 120F.

The downstream end portion 120F of each second elastic piece 120 is positioned within a range A1 in the discharging direction D2 from the regulating surface 97 to the bending portion 112 of the first elastic piece 110. In other words, with respect to the discharging direction D2, the downstream end portion 120F of each second elastic piece 120 is positioned within the range A1 from the regulating surface 97 to the bending portion 112 of the first elastic piece 110. In the present embodiment, the position in the discharging direction D2 of the downstream end portion 120F of the second elastic piece 120 is the same as the position in the discharging direction D2 of the bending portion 112 of the first elastic piece 110. That is, the second elastic piece 120 is shorter than the first elastic piece 110.

As illustrated in FIGS. 3 and 4, one of the two rollers 48 is positioned further in the one direction in the width direction than the other of the two rollers 48 (in the present embodiment, one of the two rollers 48 is positioned on one side in the width direction and the other of the two rollers 48 is positioned on the other side in the width direction). At least one of the three first elastic pieces 110 is positioned between the two rollers 48 in the width direction but the two second elastic pieces 120 are not positioned between the two rollers 48 in the width direction.

As described above, the elastic pieces 100 include the two second elastic pieces 120. In the width direction, one of the two second elastic pieces 120 is positioned further in the one direction than the one of the rollers 48, which is positioned further in the one direction in the width direction than the other of the two rollers 48. In the width direction, the other of the two second elastic pieces 120 is positioned further in the other direction than the other of the two rollers 48, which is positioned further in the other direction in the width direction than the one of the two rollers 48. In other words, the two rollers 48 are positioned between the two second elastic pieces 120 in the width direction.

The two second elastic pieces 120 are spaced apart from each other by a distance in the width direction. The distance in the width direction between the two second elastic pieces 120 is smaller than both the length in the width direction of a postcard and the length in the width direction of an A5-size paper. Hence, when the conveying unit 4 conveys the sheets SH such as the postcard, the A4-size paper, and the A5-size paper, the two second elastic pieces 120 contact all of such types of the sheets SH.

As described above, the elastic pieces 100 include the two first elastic pieces 110 besides the first elastic piece 110 that is positioned between the two rollers 48. One of the two first elastic pieces 110 is positioned further in the one direction in the width direction than the one of the two second elastic pieces 120, which is positioned further in the one direction in the width direction than the other of the two second elastic pieces 120. The other of the two first elastic pieces 110 is positioned further in the other direction in the width direction than the other of the two second elastic pieces 120, which is positioned further in the other direction in the width direction than the one of the two second elastic pieces 120. In other words, the two second elastic pieces 120 are positioned between the two first elastic pieces 120 in the width direction.

That is, the first elastic pieces 110 and the second elastic pieces 120 are alternately arranged in the width direction.

As illustrated in FIG. 4, the first elastic piece 110 positioned between the two rollers 48 has a length WL1A in the width direction, and each of the remaining two first elastic pieces 110 has a length WL1B. The length WL1A of the first elastic piece 110 in the width direction is greater than the length WL1B of each of the remaining two first elastic pieces 110 in the width direction. Each of the second elastic pieces 120 has a length WL2 in the width direction. The length WL2 of each of the second elastic piece 120 in the width direction is substantially the same as the length WL1B of each of the remaining two first elastic pieces 110 in the width direction.

As illustrated in FIG. 5, the position in the up-down direction of the bending portion 112 of each first elastic piece 110 in a state where the first elastic piece 110 is not in contact with the sheet SH being guided by the upper surface 31G of the lower sheet guide 31 will be called an initial position H1.

Figure 7:
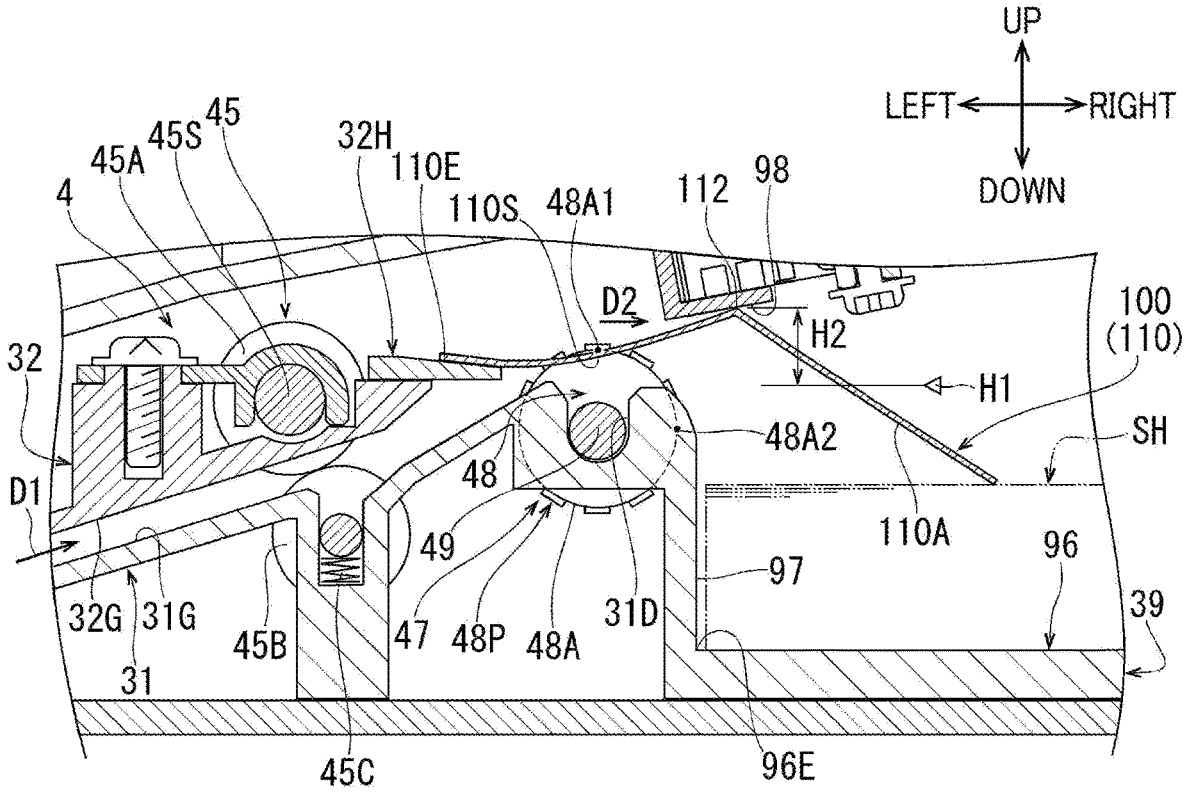
FIG. 7 is a schematic partial cross-sectional view of the image-reading device taken along line VI-VI in FIG. 4 and specifically illustrates a state where a contacting portion is in contact with a bending portion.

The image-reading device 1 further includes a contacting portion 98. Specifically, a part of the back surface of the feeding tray 91 is configured of a member having a surface facing downward which serves as the contacting portion 98. That is, the contacting portion 98 is the surface of the member which faces downward. As illustrated in FIG. 7, the contacting portion 98 is configured to contact the bending portion 112 from above when the bending portion 112 has elevated by a predetermined distance H2 from the initial position H1.

<Operation and Technical Advantages>

According to the image-reading device 1 of the first embodiment, in a case where the image-reading unit 3 reads an image formed on the sheet SH supported by the feeding tray 91, the feeding roller 41, the separating roller 42 and the separating pad 42A of the conveying unit 4 convey the sheets SH supported by the feeding tray 91 one by one.

Next, the pair of first conveying rollers 43 conveys the sheet SH being guided by both the first conveying guide 35 and the second conveying guide 36 to cause the sheet SH to pass above the reading sensor 3S positioned at the static reading position. With this configuration, the reading sensor 3S reads the image formed on the surface of the sheet SH.

Thereafter, the pair of second conveying rollers 45 conveys toward the discharging roller 47 the sheet SH being guided by both the upper surface 31G of the lower sheet guide 31 and the lower surface 32G of the upper sheet guide 32. The rollers 48 of the discharging roller 47, the first elastic pieces 110, and the second elastic pieces 120 convey the sheet SH in the discharging portion D2 to discharge the sheet SH onto the discharge tray 96.

Figure 8:
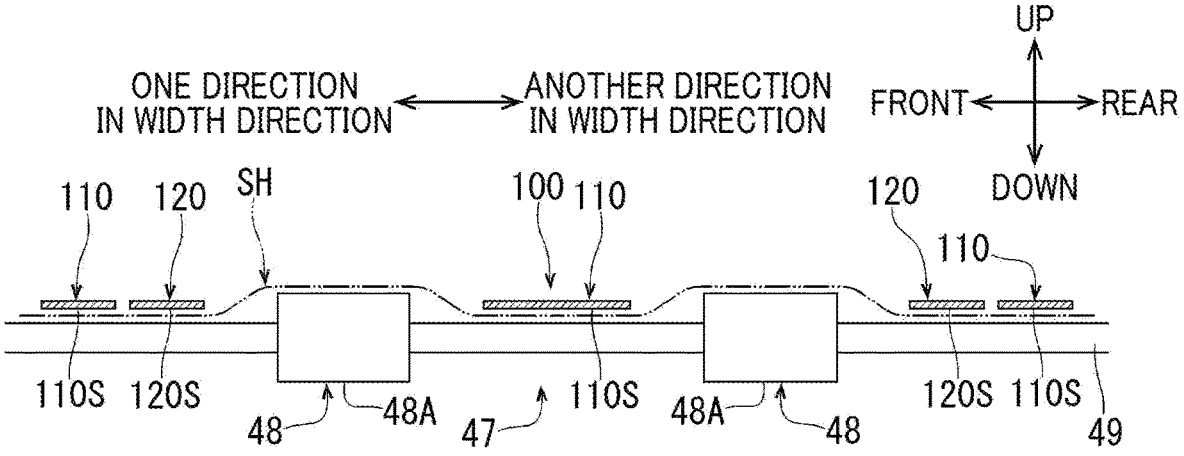
FIG. 8 is a schematic partial cross-sectional view of the image-reading device taken along line VIII-VIII in FIGS. 5 and 6.

At this time, as illustrated in FIG. 8, the first elastic pieces 110 and the second elastic pieces 120 deforms the sheet SH being discharged by the discharging roller 47 into a wavy shape when viewed in the discharging direction D2 to press the sheet SH against the outer circumferential surfaces 48A of the rollers 48 while enhancing the rigidity of the sheet SH. The plurality of elastic pieces 100 (i.e., the first elastic pieces 110 and the second elastic pieces 120) is an example of the "pressing member" in the present disclosure.

With this configuration, in comparison with a configuration that includes neither the discharging roller 47, nor the first elastic pieces 110 nor the second elastic pieces 120, the maximum number of the sheets SH that can be stacked on the discharge tray 96 can be increased, thereby enhancing the certainty of discharge of the sheets SH and stabilizing the postures of the sheets SH being discharged.

As illustrated in FIG. 5, the portions 110A of the first elastic pieces 110, which are positioned downstream relative to the bending portions 112 in the discharging direction D2, are configured to drop the sheet SH onto the discharge tray 96 while suppressing the sheet SH from being curled by pressing the sheet SH toward the discharge tray 96.

Figure 9:
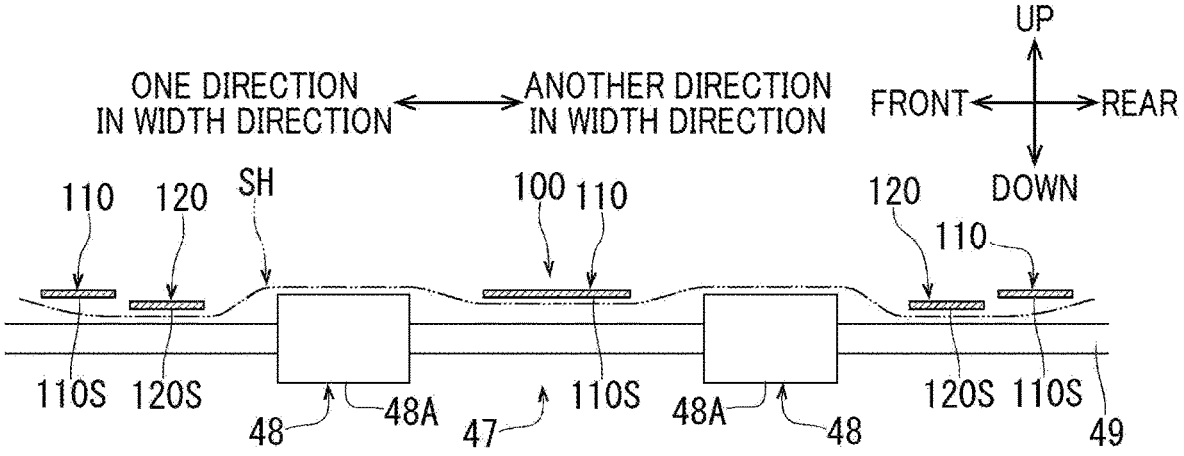
FIG. 9 is a schematic partial cross-sectional view of the image-reading device taken along line VIII-VIII in FIGS. 5 and 6 and specifically illustrates a state where the first elastic piece has elevated as a result of increase in the number of sheets supported by the discharge tray.

As illustrated in FIG. 7, the first elastic pieces 110 is elevated (moved upward) as the number of the sheets SH stacked on the discharge tray 96 increases. However, as illustrated in FIGS. 6 and 9, since the second elastic pieces 120 do not have a bending portion, the second elastic pieces 120 press the sheet SH against the outer circumferential surfaces 48A of the two rollers 48 without being elevated.

As a result, the image-reading device 1 can suppress the stacking order of the sheets SH discharged on the discharge tray 96 from being changed and can also suppress the sheets SH from being jammed.

In the image-reading device 1 of the present embodiment, components corresponding to a first shaft, a first discharging roller, and a contacting flag member which are provided in a conventional sheet discharging device do not exist at positions upward relative to the rollers 48.

Accordingly, with a simple structure, the image-reading device 1 of the first embodiment can be made compact in the up-down direction and the stacking performance of the sheets SH discharged on the discharge tray 96 can be enhanced.

As illustrated in FIGS. 5 and 6, in the image-reading device 1, the upstream end portions 110E of the first elastic pieces 110 in the discharging direction D2 and the upstream end portions 120E of the second elastic pieces 120 in the discharging direction D2 are held by the upper sheet guide 32 via the elastic piece holding portion 32H. The first elastic pieces 110 and the second elastic pieces 120 extends across the discharge path P1 in a state where the first elastic pieces 110 and the second elastic pieces 120 are not in contact with the sheet SH being guided by the upper surface 31G of the lower sheet guide 31. This configuration can achieve with a high level of certainly that the first elastic pieces 110 and the second elastic pieces 120 press the sheet SH being discharged by the discharging roller 47 against the outer circumferential surfaces 48A of the two rollers 48 while enhancing the rigidity of the sheet SH by deforming the sheet SH into a wavy shape when viewed in the discharging direction H2.

Further, in the image-reading device 1, as illustrated in FIG. 5, the bending portions 112 of the first elastic pieces 110 are positioned downstream relative to the regulating surface 97 in the discharging direction D2. This configuration can easily ensure a sufficient maximum height of the pile of the sheets SH that can be discharged and stacked on the discharge tray 96.

According to the image-reading device 1, the distance L1 in the discharging direction D2 between the bending portion 112 of the first elastic piece and the downstream end 48A2 of the outer circumferential surface 48A of the roller 48 in the discharging direction D2 is smaller than the diameter L2 of the outer circumferential surface 48A. With this configuration, a sufficient maximum height of the pile of the discharged sheets SH that can stacked on the discharge tray 96 can be ensured and change in the stacking order of the sheets SH discharged on the discharge tray 96 can be suppressed by the portions 110A of the first elastic pieces 110, which are positioned downstream relative to the bending portions 112 in the discharging direction D2.

Further, according to the image-reading device 1, with respect to the discharging direction D2, the downstream end portions 120F of the second elastic pieces 120 in the discharging direction D2 are positioned within the range A1 from the regulating surface 97 to the bending portions 112 of the first elastic pieces 110 as illustrated in FIG. 6. This configuration can achieve with a high level of certainty that the second elastic pieces 120 press the sheet SH against the outer circumferential surfaces 48A of the two rollers 48 despite increase in the number of the sheets SH supported on the discharge tray 96.

According to the image-reading device 1, as illustrated in FIG. 4, one of the two rollers 48 is positioned further in the one direction in the width direction than the other of the two rollers 48. In other words, the other of the two rollers 48 is positioned further in the other direction in the width direction than the one of the two rollers 48. The elastic pieces 100 include at least one first elastic piece 110 positioned between the two rollers 48 in the width direction. This configuration can achieve with a high level of certainty that, regardless of the size of the sheet SH being discharged, the first elastic piece 110 positioned between the two rollers 48 drops the sheet SH onto the discharge tray 96 while suppressing the sheet SH from being curled by pressing the sheet SH toward the discharge tray 96.

Furthermore, according to the image-reading device 1, the elastic pieces 100 include the two second elastic pieces 120 as described above. One of the two second elastic pieces 120 is positioned further in the one direction in the width direction than the one of the two rollers 48, which is positioned further in the one direction in the width direction than the other of the two rollers 48. The other of the two second elastic pieces 120 is positioned further in the other direction in the width direction than the other of the two rollers 48, which is positioned further in the other direction in the width direction than the one of the two rollers 48. This configuration can achieve with a high level of certainty that the two second elastic pieces 120 press the sheet SH against the outer circumferential surfaces 48A of the two rollers 48, regardless of the size of the sheet SH being discharged.

According to the image-reading device 1, the elastic piece 100 further includes the remaining two first elastic pieces 110 as described above. One of the remaining two first elastic pieces 110 is positioned further in the one direction in the width direction than the one of the two second elastic pieces 120, which is positioned further in the one direction in the width direction than the other of the two second elastic pieces 120. The other of the remaining two first elastic pieces 110 is positioned further in the other direction in the width direction than the other of the two second elastic pieces 120, which is positioned further in the other direction in the width direction than the one of the two second elastic pieces 120. This configuration can achieve with a high level of certainty that, when the sheet SH having a large size is discharged, the two first elastic pieces 110 positioned outward of the two second elastic pieces 120 in the width direction drop the sheet SH onto the discharge tray 96 while suppressing the sheet SH from being curled by pressing the sheet SH toward the discharge tray 96.

In addition, according to the image-reading device 1, the length WL1A in the width direction of the first elastic piece 110 positioned between the two rollers 48 is greater than the length WL1B in the width direction of the remaining two first elastic pieces 110. This configuration can achieve with a high level of certainty that, when the sheet SH having a small size and a high stiffness, such as a postcard, is discharged, the first elastic piece 110 positioned between the two rollers 48 drops the sheet SH onto the discharge tray 96 while suppressing the sheet SH from being curled by pressing the sheet SH toward the discharge tray 96.

According to the image-reading device 1, the first elastic pieces 110 and the second elastic pieces 120 have a film-like shape. Hence, the first elastic pieces 110 and the second elastic pieces 120 can be easily manufactured at a low cost.

Moreover, as illustrated in FIG. 3, the image-reading device 1 further includes the first gear 21 and the second gear 22. The first gear 21 is positioned further in the one direction in the width direction than the discharge path P1. The first gear 21 is configured to rotate together with the driving shaft 45S. The second gear 22 is positioned further in the one direction in the width direction than the discharge path P1. The second gear 22 is configured to rotate together with the shaft 49. The first gear 21 and the second gear 22 is meshingly engaged with each other. Since the driving rollers 45A of the pair of second conveying rollers 45 and the rollers 48 of the discharging roller 47 whose rotational direction is opposite to the rotational direction of the driving rollers 45A are directly connected to each other by the first gear 21 and the second gear 22, reduction of the number of the components and simplification of the driving gear-train can be realized.

As illustrated in FIG. 7, the image-reading device 1 further includes the contacting portion 98 configured to contact the bending portions 112 from above when the bending portions 112 have been elevated by the predetermined distance H2 from the first position H1. Since the contacting portion 98 contacts the bending portions 112 from above when the bending portions 112 have elevated by the predetermined distance H2, the portions 110A of the first elastic pieces 110, which are positioned downstream relative to the bending portions 112 in the discharging direction D2, press the sheets SH with a larger force as the number of the sheets SH supported on the discharge tray 96 increases. This configuration can achieve with a high level of certainty that, despite increase in the number of the sheets SH supported by the discharge tray 96, the portions 110A drop the sheet SH onto the discharge tray 96 while suppressing the sheet SH from being curled by pressing the sheet SH toward the discharge tray 96.

Second Embodiment

Figure 10:
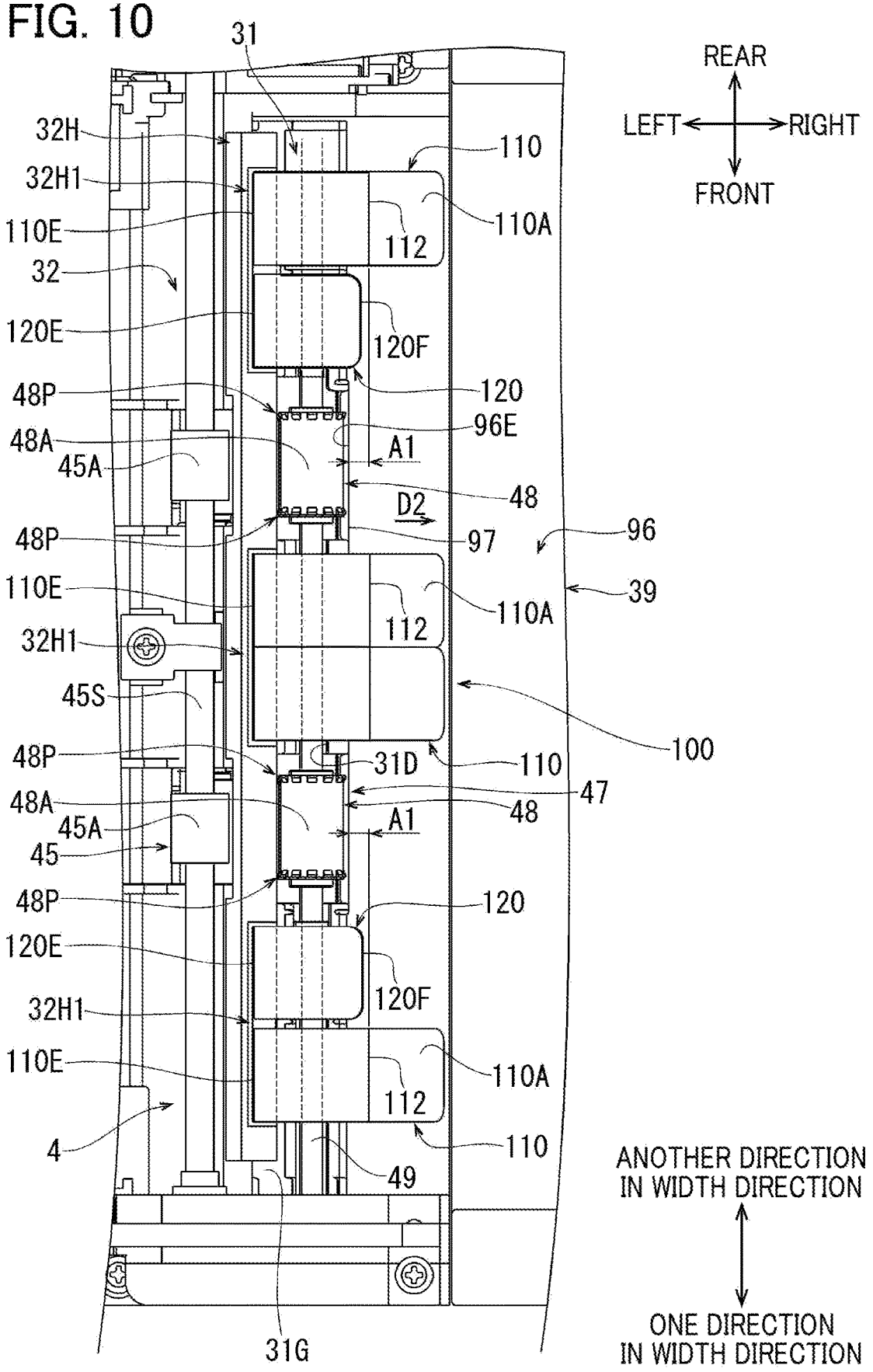
FIG. 10 is a plan view of part of an image-reading device and specifically illustrates a discharging roller, first elastic pieces, second elastic pieces, a discharge tray, and other components.

As illustrated in FIG. 10, an image-reading device according to the second embodiment is different from the image-reading device 1 according to the first embodiment in that, in place of the first elastic piece 110 of the image-reading device 1 which is positioned between the two rollers 48, two first elastic pieces 110 which have the same shapes as those of the remaining two first elastic pieces 100 of the image-reading device 1 are arranged side by side in the width direction.

Also, in the second embodiment, the downstream end portions 120F of the two second elastic pieces 120 in the discharging direction D2 are positioned upstream in the discharging direction D2 relative to the bending portions 112 of the first elastic pieces 110 within the range A1, unlike the downstream end portions 120F of the two second elastic pieces 120 in the first embodiment.

Further, in the second embodiment, ribs 32H1 are provided on the upper surface of the elastic piece holding portion 32H to fix the first elastic pieces 110 and the second elastic pieces 120 in position. Each rib 32H1 has an approximately C-shape in a plan view and surrounds the upstream end portion 110E of the corresponding first elastic piece 110 and the upstream end portion 120E of the corresponding second elastic piece 120 from the left side and from the outside in the width direction, as illustrated in FIG. 10. With this configuration, the accuracy of positioning the first elastic pieces 110 and the second elastic pieces 120 when attaching the first elastic pieces 110 and the second elastic pieces 120 to the upper surface of the elastic piece holding portion 32H can be enhanced.

Since the other parts and components in the second embodiment are identical to those in the first embodiment, like parts and components are designated with the same reference numerals and duplicate descriptions are omitted.

Similarly to the image-reading device 1 of the first embodiment, with a simple structure, the image-reading device of the second embodiment can be made compact in the up-down direction and the stacking performance of the sheets SH discharged on the discharge tray 96 can be enhanced.

Third Embodiment

Figure 11:
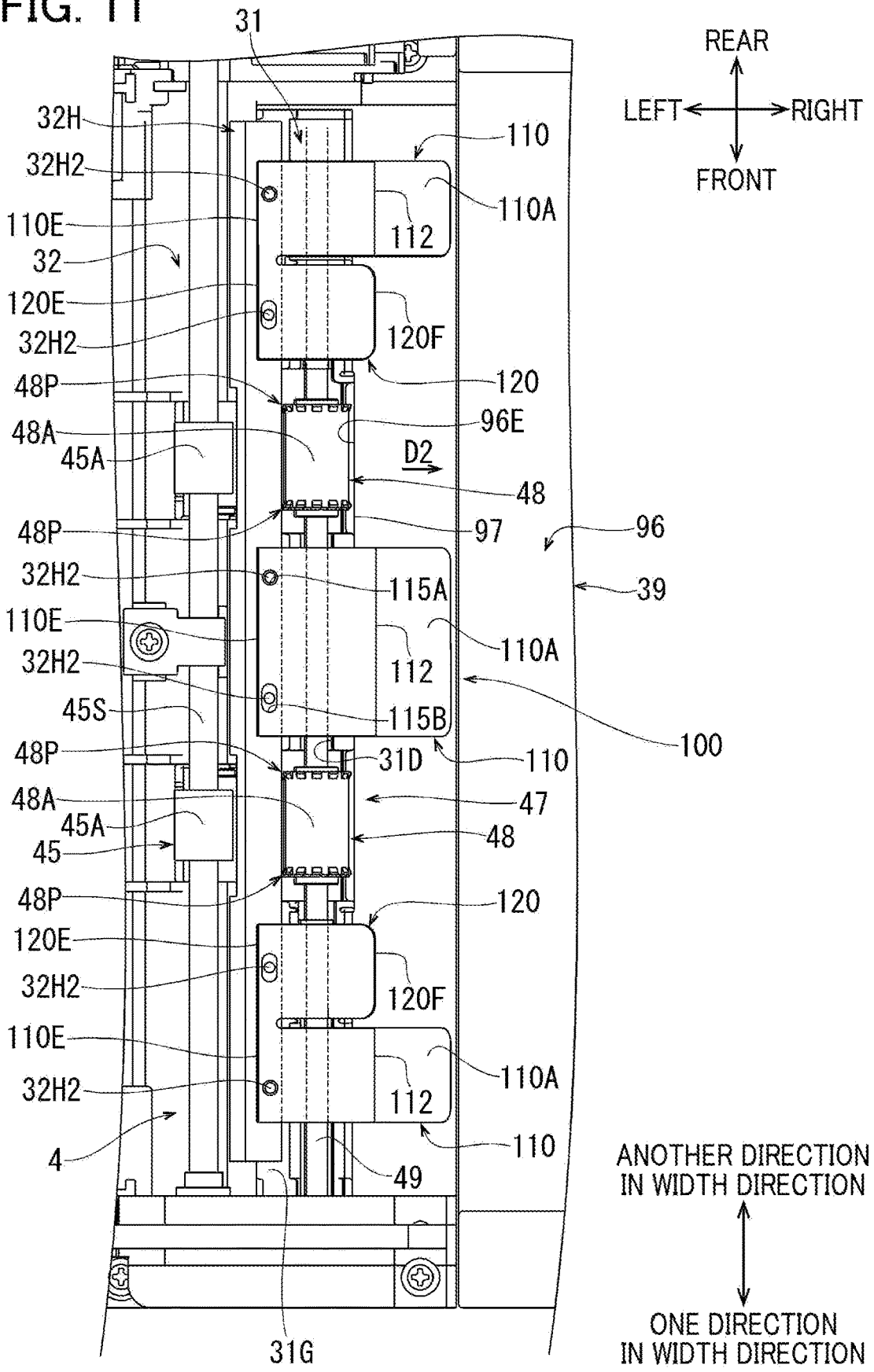
FIG. 11 is a plan view of part of an image-reading device and specifically illustrates a discharging roller, first elastic pieces, second elastic pieces, a discharge tray, and other components.

As illustrated in FIG. 11, an image-reading device according to the third embodiment includes, in place of two pairs of the first elastic piece 110 and the second elastic piece 120 of the image-reading device 1 which are positioned outward in the width direction relative to the two rollers 48, two pairs of first elastic piece 110 and second elastic piece 120 which are formed as a single member by connecting the upstream end portion 110E side and the upstream end portion 120E side in the discharging direction D2. With this configuration, the first elastic piece 110 and the second elastic piece 120 are easily manufactured by cutting out the first elastic piece 110 and the second elastic piece 120 together from a single film-like material and bending the first elastic piece 110 at the bending portion 112. Note that, although not illustrated, all of the first elastic pieces 110 and second elastic pieces 120 can be formed as a single member with the upstream end portion 110E sides and the upstream end portion 120E sides connected to one another.

In the third embodiment, columnar portions 32H2 are provided on the upper surface of the elastic piece holding portion 32H to fix the first elastic pieces 110 and second elastic pieces 120 in position. The columnar portions 32H2 are linearly arranged in the width direction and spaced apart from one another in the width direction.

The first elastic piece 110 positioned between the two rollers 48 is formed with a round hole 115A and an elongated hole 115B, which are spaced apart from each other in the width direction. By inserting the columnar portions 32H2 into the round hole 115A and the elongated hole 115B, the accuracy of positioning the first elastic piece 110 when attaching the first elastic piece 110 to the upper surface of the elastic piece holding portion 32H can be enhanced.

Each of the two pairs of the first elastic piece 110 and the second elastic piece 120 positioned outward relative to the two rollers 48 in the width direction also has a round hole the same as the round hole 115A and an elongated hole the same as the elongated hole 115B.

Since the other parts and components in the third embodiment are identical to those in the first embodiment, like parts and components are designated with the same reference numerals and duplicate descriptions are omitted.

Similarly to the image-reading device 1 of the first embodiment and the image-reading device of the second embodiment, with a simple structure, the image-reading device of the third embodiment can be made compact in the up-down direction and the stacking performance of the sheets SH discharged on the discharge tray 96 can be enhanced.

Fourth Embodiment

Figure 12:
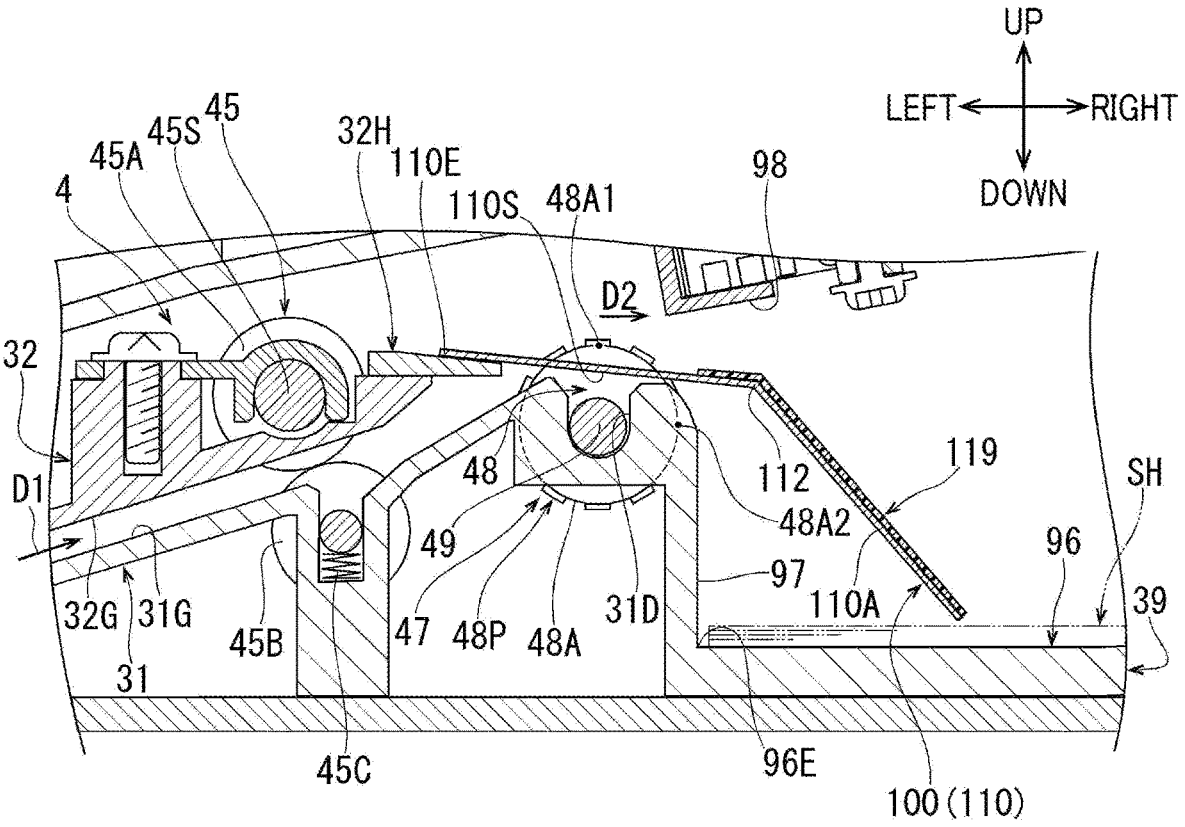
FIG. 12 is a schematic partial cross-sectional view of an image-reading device which corresponds to the schematic partial cross-sectional view of FIG. 5.

As illustrated in FIG. 12, an image-reading device according to the fourth embodiment is different from the image-reading device 1 according to the first embodiment in that reinforcement plates 119 are attached to the upper surfaces (the surfaces facing upward) of the three first elastic pieces 110. Each reinforcement plate 119 reinforces at least the bending portion 112 of the corresponding first elastic piece 110. In the fourth embodiment, each reinforcement plate 119 is made of resin and reinforces the portion of the corresponding first elastic piece 110 which extends from the position directly above the regulating surface 97 to the tip end (the downstream end) in the discharging direction D2.

Since the other parts and components in the fourth embodiment are identical to those in the first embodiment, like parts and components are designated with the same reference numerals and duplicate descriptions are omitted.

Similarly to the image-reading device 1 of the first embodiment and the image-reading devices of the second and third embodiments, with a simple structure, the image-reading device of the fourth embodiment can be made compact in the up-down direction and the stacking performance of the sheets SH discharged on the discharge tray 96 can be enhanced.

In the image-reading device according to the fourth embodiment, the portions 110A of the first elastic pieces 110 which are positioned downstream in the discharging direction D2 relative to the bending portions 112 are reinforced by the reinforcement plates 119. This configuration can achieve with a high level of certainty that the first elastic pieces 110 drop the sheet SH being discharged onto the discharge tray 96 while suppressing the sheet SH from being curled by pressing the sheet SH toward the discharge tray 96.

Modifications and Variations

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

In the first through fourth embodiments, the upstream end portions 110E of the first elastic pieces 110 and the upstream end portions 120E of the second elastic pieces 120 are held by the upper sheet guide 32 via the elastic piece holding portion 32H. However, the present disclosure is not limited to this configuration. For example, the upstream end portions 110E of the first elastic pieces 110 and the upstream end portions 120E of the second elastic pieces 120 may be held directly by the upper sheet guide 32.

In the fourth embodiment, each reinforcement plate 119 reinforces the entire portion 110A of the corresponding first elastic piece 110, which is positioned downstream in the discharging direction D2 relative to the bending portion 112. However, the present disclosure is not limited to the configuration. For example, the reinforcement plate 119 may reinforce a part of the portion 110A of the corresponding first elastic piece 110, which is positioned downstream in the discharging direction D2 relative to the bending portion 112.

The present disclosure can be applied to other sheet discharging devices, such as an image-forming device, image-reading device, a multifunction peripheral having an image forming function and an image reading function.

What is claimed is:

1. A sheet discharging device comprising:

a lower sheet guide having an upper surface configured to guide a sheet;

a discharging roller comprising:

a shaft positioned downward relative to the upper surface, the shaft extending in a width direction orthogonal to a conveying direction of the sheet being guided by the upper surface; and a roller body configured to rotate together with the shaft, the roller body being configured to convey the sheet being guided by the upper surface in a discharging direction;

a plurality of elastic pieces protruding in the discharging direction, each elastic piece being arranged upward relative to the shaft and offset from the roller body in the width direction; and a discharge tray configured to support the sheet discharged by the discharging roller, wherein each elastic piece has a surface facing downward, the surface of each elastic piece having a portion directly above the shaft, the portion being positioned downward relative to an upper end of an outer circumferential surface of the roller body in a state where the portion is not in contact with the sheet being guided by the upper surface, wherein the plurality of elastic pieces comprises:

a first elastic piece including a bending portion bent toward the discharge tray, the bending portion being positioned downstream in the discharging direction relative to the shaft; and a plurality of second elastic pieces each shorter than the first elastic piece, each second elastic piece not including a bending portion bent toward the discharge tray, and wherein the first elastic piece and the plurality of second elastic pieces are alternately arranged in the width direction.

2. The sheet discharging device according to claim 1, further comprising:

an upper sheet guide having a lower surface facing the upper surface of the lower sheet guide from above, the lower surface of the upper sheet guide being configured to guide the sheet, wherein the upper surface and the lower surface define a discharge path therebetween, wherein an upstream end portion in the discharging direction of the first elastic piece and an upstream end portion in the discharging direction of each second elastic piece are held by the upper sheet guide, wherein the first elastic piece extends across the discharge path in a state where the first elastic piece is not in contact with the sheet being guided by the upper surface, and wherein each second elastic piece extends across the discharge path in a state where the second elastic piece is not in contact with the sheet being guided by the upper surface.

3. The sheet discharging device according to claim 1, further comprising:

a regulating surface connected to an upstream end of the discharge tray in the discharging direction, the regulating surface extending upward and extending in the width direction, the regulating surface facing in the discharging direction, the regulating surface being configured to regulate the sheet discharged by the discharging roller, wherein the bending portion of the first elastic piece is positioned downstream in the discharging direction relative to the regulating surface.

4. The sheet discharging device according to claim 3, wherein a downstream end of the outer circumferential surface of the roller body in the discharging direction and the bending portion of the first elastic piece are spaced apart from each other in the discharging direction by a distance that is smaller than a diameter of the outer circumferential surface.

5. The sheet discharging device according to claim 3, wherein, with respect to the discharging direction, a downstream end portion of each second elastic piece in the discharging direction is positioned within a range from the regulating surface to the bending portion of the first elastic piece.

6. The sheet discharging device according to claim 1, wherein the roller body comprises a plurality of roller bodies each fixed to the shaft, and wherein the first elastic piece is positioned between the plurality of roller bodies in the width direction but the plurality of second elastic pieces is not positioned between the plurality of roller bodies in the width direction.

7. The sheet discharging device according to claim 6, wherein one of the plurality of roller bodies is positioned further in one direction in the width direction than another of the plurality of roller bodies, wherein the plurality of second elastic pieces comprises two second elastic pieces, wherein one of the two second elastic pieces is positioned further in the one direction in the width direction than the one of the plurality of roller bodies, and wherein another of the two second elastic pieces is positioned further in another direction in the width direction than the another of the plurality of roller bodies.

8. The sheet discharging device according to claim 7, wherein the plurality of elastic pieces further comprises two first elastic pieces besides the first elastic piece which is positioned between the plurality of roller bodies, wherein one of the two first elastic pieces is positioned further in the one direction in the width direction than the one of the two second elastic pieces, and wherein another of the two first elastic pieces is positioned further in the another direction in the width direction than the another of the two second elastic pieces.

9. The sheet discharging device according to claim 8, wherein the first elastic piece positioned between the plurality of roller bodies has a length in the width direction that is greater than a length in the width direction of each of the two first elastic pieces.

10. The sheet discharging device according to claim 8, wherein at least one of the first elastic pieces and at least one of the plurality of second elastic pieces are formed as a single member.

11. The sheet discharging device according to claim 1, wherein the first elastic piece and the plurality of second elastic pieces are films.

12. The sheet discharging device according to claim 11, wherein the first elastic piece has a surface facing upward, and wherein a reinforcement plate reinforcing at least the bending portion is attached to the surface facing upward.

13. The sheet discharging device according to claim 1, further comprising:

an upper sheet guide having a lower surface facing the upper surface of the lower sheet guide from above, the lower surface of the upper sheet guide being configured to guide the sheet; and a pair of conveying rollers positioned upstream in the discharging direction relative to the discharging roller, the pair of conveying rollers being configured to convey toward the discharging roller the sheet being guided by the upper surface and the lower surface, wherein the upper surface and the lower surface define a discharge path therebetween, wherein the pair of conveying rollers comprises:

a driving shaft extending in the width direction, the driving shaft being positioned upward relative to the lower surface;

a driving roller body configured to rotate together with the driving shaft; and a follow roller body facing the driving roller body, the follow roller body being positioned on a side on which the upper surface is positioned, and wherein the sheet discharging device further comprises:

a first gear configured to rotate together with the driving shaft, the first gear being positioned further in one direction in the width direction than the discharge path; and a second gear configured to rotate together with the shaft, the second gear being meshingly engaged with the first gear, the second gear being positioned further in the one direction in the width direction than the discharge path.

14. The sheet discharging device according to claim 1, further comprising:

a contacting portion configured to contact the bending portion from above when the bending portion has been elevated by a predetermined distance from an initial position, the initial position being a vertical position of the bending portion in a state where the first elastic piece is not in contact with the sheet being guided by the upper surface.

15. A sheet discharging device comprising:

a lower sheet guide having an upper surface configured to guide a sheet;

a discharging roller comprising:

a shaft positioned downward relative to the upper surface, the shaft extending in a width direction orthogonal to a conveying direction of the sheet being guided by the upper surface; and a roller body configured to rotate together with the shaft, the roller body being configured to convey the sheet being guided by the upper surface in a discharging direction;

a pressing member configured to press the sheet being discharged by the discharging roller, the pressing member comprising a plurality of elastic pieces protruding in the discharging direction, each elastic piece being arranged upward relative to the shaft and offset from the roller body in the width direction; and a discharge tray configured to support the sheet discharged by the discharging roller, wherein each elastic piece has a surface facing downward, the surface of each elastic piece having a portion directly above the shaft, the portion being positioned downward relative to an upper end of an outer circumferential surface of the roller body in a state where the portion is not in contact with the sheet being guided by the upper surface, wherein the plurality of elastic pieces comprises:

a first elastic piece including a bending portion bent toward the discharge tray, the bending portion being positioned downstream in the discharging direction relative to the shaft; and a plurality of second elastic pieces each shorter than the first elastic piece, each second elastic piece not including a bending portion bent toward the discharge tray, and wherein the first elastic piece and the plurality of second elastic pieces are alternately arranged in the width direction.

16. The sheet discharging device according to claim 15, further comprising:

an upper sheet guide having a lower surface facing the upper surface of the lower sheet guide from above, the lower surface of the upper sheet guide being configured to guide the sheet, wherein the upper surface and the lower surface define a discharge path therebetween, wherein an upstream end portion in the discharging direction of the first elastic piece and an upstream end portion in the discharging direction of each second elastic piece are held by the upper sheet guide, wherein the first elastic piece extends across the discharge path in a state where the first elastic piece is not in contact with the sheet being guided by the upper surface, and wherein each second elastic piece extends across the discharge path in a state where the second elastic piece is not in contact with the sheet being guided by the upper surface.

17. The sheet discharging device according to claim 15, further comprising:

a regulating surface connected to an upstream end of the discharge tray in the discharging direction, the regulating surface extending upward and extending in the width direction, the regulating surface facing in the discharging direction, the regulating surface being configured to regulate the sheet discharged by the discharging roller, wherein the bending portion of the first elastic piece is positioned downstream in the discharging direction relative to the regulating surface.

18. The sheet discharging device according to claim 17, wherein a downstream end of the outer circumferential surface of the roller body in the discharging direction and the bending portion of the first elastic piece are spaced apart from each other in the discharging direction by a distance that is smaller than a diameter of the outer circumferential surface.

19. The sheet discharging device according to claim 17, wherein, with respect to the discharging direction, a downstream end portion of each second elastic piece in the discharging direction is positioned within a range from the regulating surface to the bending portion of the first elastic piece.

20. The sheet discharging device according to claim 15, wherein the roller body comprises a plurality of roller bodies each fixed to the shaft, and wherein the first elastic piece is positioned between the plurality of roller bodies in the width direction but the plurality of second elastic pieces is not positioned between the plurality of roller bodies in the width direction.

* * * * *